US010738636B2

(12) United States Patent
O'Leary

(10) Patent No.: US 10,738,636 B2
(45) Date of Patent: Aug. 11, 2020

(54) DUAL WALL AIRFOIL WITH STIFFENED TRAILING EDGE

(71) Applicant: Rolls-Royce North American Technologies, Inc., Indianapolis, IN (US)

(72) Inventor: Mark O'Leary, Zionsville, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 223 days.

(21) Appl. No.: 15/378,915

(22) Filed: Dec. 14, 2016

(65) Prior Publication Data

US 2018/0163554 A1 Jun. 14, 2018

(51) Int. Cl.

| | |
|---|---|
| ***F01D 9/06*** | (2006.01) |
| ***F01D 5/18*** | (2006.01) |
| ***F01D 5/14*** | (2006.01) |

(52) U.S. Cl.

CPC ..... *F01D 9/065* (2013.01); *F01D 5/147* (2013.01); *F01D 5/189* (2013.01); *F05D 2230/90* (2013.01); *F05D 2240/122* (2013.01); *F05D 2250/182* (2013.01); *F05D 2260/202* (2013.01); *F05D 2300/6033* (2013.01)

(58) Field of Classification Search

CPC ..... F01D 9/065; F01D 5/145–147; F01D 5/18–189; F05D 2240/122

USPC ..... 416/97 R

See application file for complete search history.

(56) References Cited

U.S. PATENT DOCUMENTS

| | | | | | |
|---|---|---|---|---|---|
| 3,726,604 | A * | 4/1973 | Helms | F01D 5/184 | 415/115 |
| 4,437,810 | A * | 3/1984 | Pearce | F01D 5/189 | 415/115 |
| 5,259,730 | A * | 11/1993 | Damlis | B23P 15/04 | 416/96 A |
| 5,288,207 | A * | 2/1994 | Linask | F01D 5/187 | 416/97 R |
| 5,384,959 | A | 1/1995 | Velicki | | |
| 5,630,700 | A * | 5/1997 | Olsen | F01D 5/189 | 415/134 |
| 5,652,044 | A * | 7/1997 | Rickerby | C23C 10/48 | 427/248.1 |
| 6,224,339 | B1 * | 5/2001 | Rhodes | F01D 5/186 | 416/224 |
| 6,234,754 | B1 * | 5/2001 | Zelesky | F01D 5/187 | 415/115 |
| 6,398,501 | B1 | 6/2002 | Darkins, Jr. et al. | | |
| 7,086,829 | B2 * | 8/2006 | Fuller | F01D 5/186 | 415/115 |
| 7,828,515 | B1 | 11/2010 | Kimmel | | |
| 7,845,908 | B1 * | 12/2010 | Liang | F01D 5/187 | 416/97 R |

(Continued)

FOREIGN PATENT DOCUMENTS

| | | | | |
|---|---|---|---|---|
| GB | 2246174 A * | 1/1992 | ..... | F01D 5/187 |
| JP | 60192803 A * | 10/1985 | ..... | F01D 5/189 |

*Primary Examiner* — Woody A Lee, Jr.
*Assistant Examiner* — Andrew Thanh Bui
(74) *Attorney, Agent, or Firm* — Barnes & Thornburg LLP

(57) ABSTRACT

An airfoil adapted for use in a gas turbine engine is disclosed herein. The airfoil includes a spar defining an interior space and a cover sheet extending around at least a portion of the spar. The cover sheet is bonded to the spar to define a cooling cavity between the spar and the cover sheet.

20 Claims, 3 Drawing Sheets

(56) References Cited

U.S. PATENT DOCUMENTS

| | | | | |
|---|---|---|---|---|
| 8,162,617 | B1 | 4/2012 | Davies et al. | |
| 8,366,398 | B1 | 2/2013 | Kimmel | |
| 8,608,430 | B1 | 12/2013 | Liang | |
| 8,944,773 | B2 | 2/2015 | Weisse | |
| 2003/0017051 | A1* | 1/2003 | Coutandin | F01D 5/187 416/97 R |
| 2012/0189427 | A1 | 7/2012 | Kwon et al. | |
| 2012/0201653 | A1* | 8/2012 | Moga | F01D 5/147 415/115 |

* cited by examiner

DUAL WALL AIRFOIL WITH STIFFENED TRAILING EDGE

STATEMENT REGARDING FEDERALLY SPONSORED RESEARCH OR DEVELOPMENT

Embodiments of the present disclosure were made with government support under Contract No. FA8650-07-C-2803. The government may have certain rights.

FIELD OF THE DISCLOSURE

The present disclosure relates generally to gas turbine engines, and more specifically to airfoils used in gas turbine engines.

BACKGROUND

Various techniques are used to construct airfoils to achieve desired geometries at the trailing edges of the airfoils. Airfoil trailing edge thicknesses may impact the performance of gas turbine engine components including the airfoils. Constructing airfoils to achieve desired airfoil thicknesses and thereby improve the performance of such components remains an area of interest.

SUMMARY

The present disclosure may comprise one or more of the following features and combinations thereof.

An airfoil according to the present disclosure may include a spar. The spar may define an interior space and may include thickened portions creating tabs that define a plurality of outwardly-opening channels at the trailing edge of the airfoil along a suction side of the airfoil.

In illustrative embodiments, the airfoil may include a cover sheet. The cover sheet may extend around at least a portion of the spar. The cover sheet may be bonded to the tabs of the spar to create slots at the trailing edge of the airfoil.

In illustrative embodiments, the slots may open into a cooling cavity defined between the spar and the cover sheet. The cooling cavity may extend along the suction side of the airfoil forward of the tabs.

In illustrative embodiments, the spar may define a central cooling air plenum adapted to be pressurized with cooling air and may be formed to include cooling air passages fluidly coupling the central cooling air plenum to the cooling cavity.

In illustrative embodiments, the tabs may be spaced apart from one another in a radial direction extending along the trailing edge of the airfoil. One of the tabs may extend to an outward-most surface of the spar in the radial direction. Another of the tabs may extend to an inward-most surface of the spar in the radial direction arranged opposite the outward-most surface of the spar.

In illustrative embodiments, the tabs may be shaped so that the outwardly-opening channels diverge as they extend toward the trailing edge of the airfoil.

In illustrative embodiments, a thermal barrier coating may be applied to at least a portion of the cover sheet facing outwardly away from the cooling cavity. The portion of the cover sheet may extend to the trailing edge of the airfoil and forward of the tabs.

According to another aspect of the present disclosure, an airfoil may include a spar. The spar may terminate at a point located forward of a trailing edge of the airfoil.

In illustrative embodiments, the airfoil may also include a cover sheet coupled to the spar to form a cooling cavity between the spar and the cover sheet along at least a portion of a suction side of the airfoil and extending from the point to the trailing edge of the airfoil. The cover sheet may include a thickened portion along the trailing edge of the airfoil formed to include a plurality of slots that extend from the trailing edge of the airfoil to the cooling cavity to fluidly couple the cooling cavity to the trailing edge of the airfoil.

In illustrative embodiments, a thickness of the cover sheet measured forward of the point may be less than a thickness of the cover sheet measured at the trailing edge of the airfoil.

In illustrative embodiments, the slots may be spaced apart from one another in a radial direction extending along the trailing edge of the airfoil.

In illustrative embodiments, the spar may define a central cooling air plenum adapted to be pressurized with cooling air. The spar may be formed to include cooling air passages fluidly coupling the central cooling air plenum to the cooling cavity.

In illustrative embodiments, a notch may be formed in one of the spar and the thickened portion. The other of the spar and the thickened portion may be received by the notch to couple the thickened portion to the spar at the point.

In illustrative embodiments, a thermal barrier coating may be applied to the cover sheet opposite the cooling cavity.

In illustrative embodiments, a cooling path extending through the plurality of slots in a radial direction along the trailing edge of the airfoil may be defined by the thickened portion. In illustrative embodiments, the slots may diverge as they extend toward the trailing edge of the airfoil.

In illustrative embodiments, the cover sheet may be constructed of one or more ceramic matrix composite materials. In some embodiments, the spar may be constructed of one or more metallic materials. In some embodiments, the spar may be constructed of one or more ceramic matrix composite materials These and other features of the present disclosure will become more apparent from the following description of the illustrative embodiments.

DETAILED DESCRIPTION OF THE DRAWINGS

Figure 1:
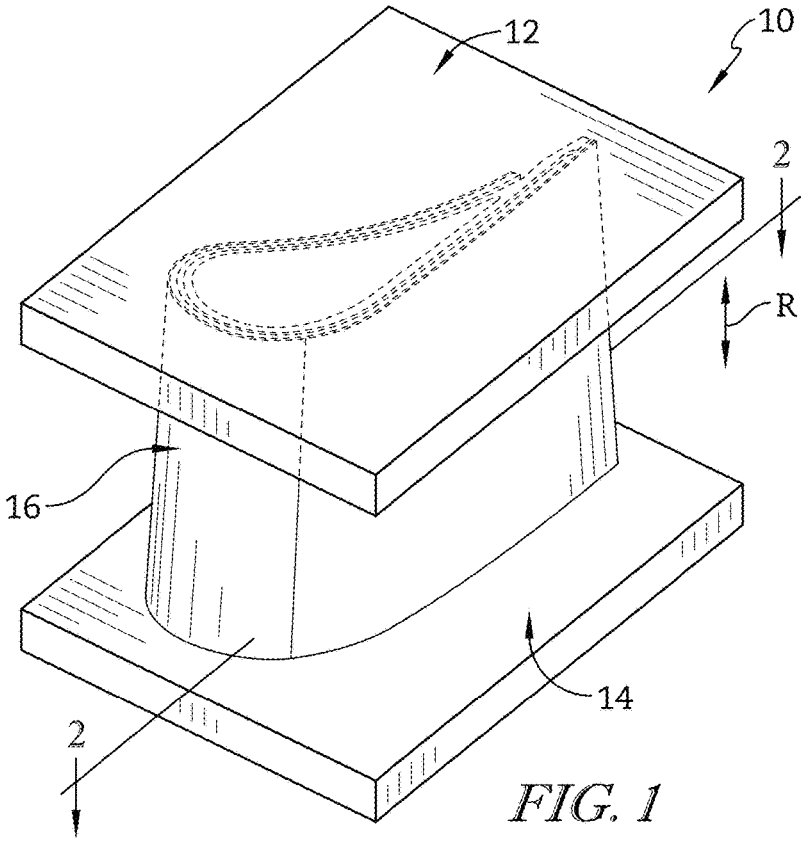
FIG. 1 is a perspective view of a vane segment adapted for use in a gas turbine engine that includes an airfoil interconnected with and extending between a pair of platforms.

Referring now to FIG. 1, a vane segment 10 illustratively configured for use in a gas turbine engine is shown. The segment 10 is illustratively embodied as a single vane adapted for use in a turbine or in a compressor. In other embodiments, however, the segment 10 may be embodied as a multi-vane segment adapted for use in a turbine or in a compressor.

The segment 10 illustratively includes a platform 12 and a platform 14 spaced from the platform 12 in a radial direction indicated by arrow R as shown in FIG. 1. The platforms 12, 14 are interconnected by an airfoil 16 that extends between the platforms 12, 14. The airfoil 16 may include features that are configured to interface with corresponding features of the platforms 12, 14 to couple the airfoil 16 to the platforms 12, 14.

Figure 2:
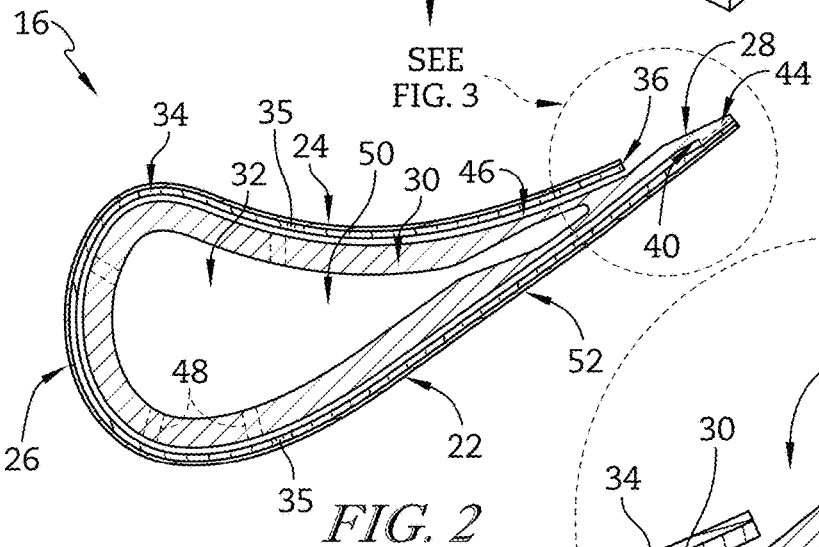
FIG. 2 is a cross-sectional view of the airfoil of the segment of FIG. 1 taken along line 2-2 showing that the airfoil includes a spar, a cover sheet extending around a portion of the spar, and a cooling cavity defined between the portion of the spar and the cover sheet.

Referring now to FIG. 2, the illustrative airfoil 16 is shown in greater detail. The airfoil 16 includes a suction side 22 and a pressure side 24 arranged opposite the suction side 22. The suction and pressure sides 22, 24 are interconnected by a leading edge 26 and a trailing edge 28 arranged opposite the leading edge 26.

The airfoil 16 illustratively includes a spar 30 that extends from the leading edge 26 to the trailing edge 28 and defines an interior space 32 as shown in FIG. 1. The airfoil 16 also includes a cover sheet 34 that extends around the spar 30 at the leading edge 26. Along the pressure side 24 of the airfoil 16, the cover sheet 34 terminates at a point 36 located forward of the trailing edge 28. However, along the suction side 22 of the airfoil 16, the cover sheet 34 extends to the trailing edge 28. Because the illustrative airfoil 16 includes the spar 30 and the cover sheet 34, the airfoil 16 may be referred to as a dual-wall airfoil.

Figure 4:
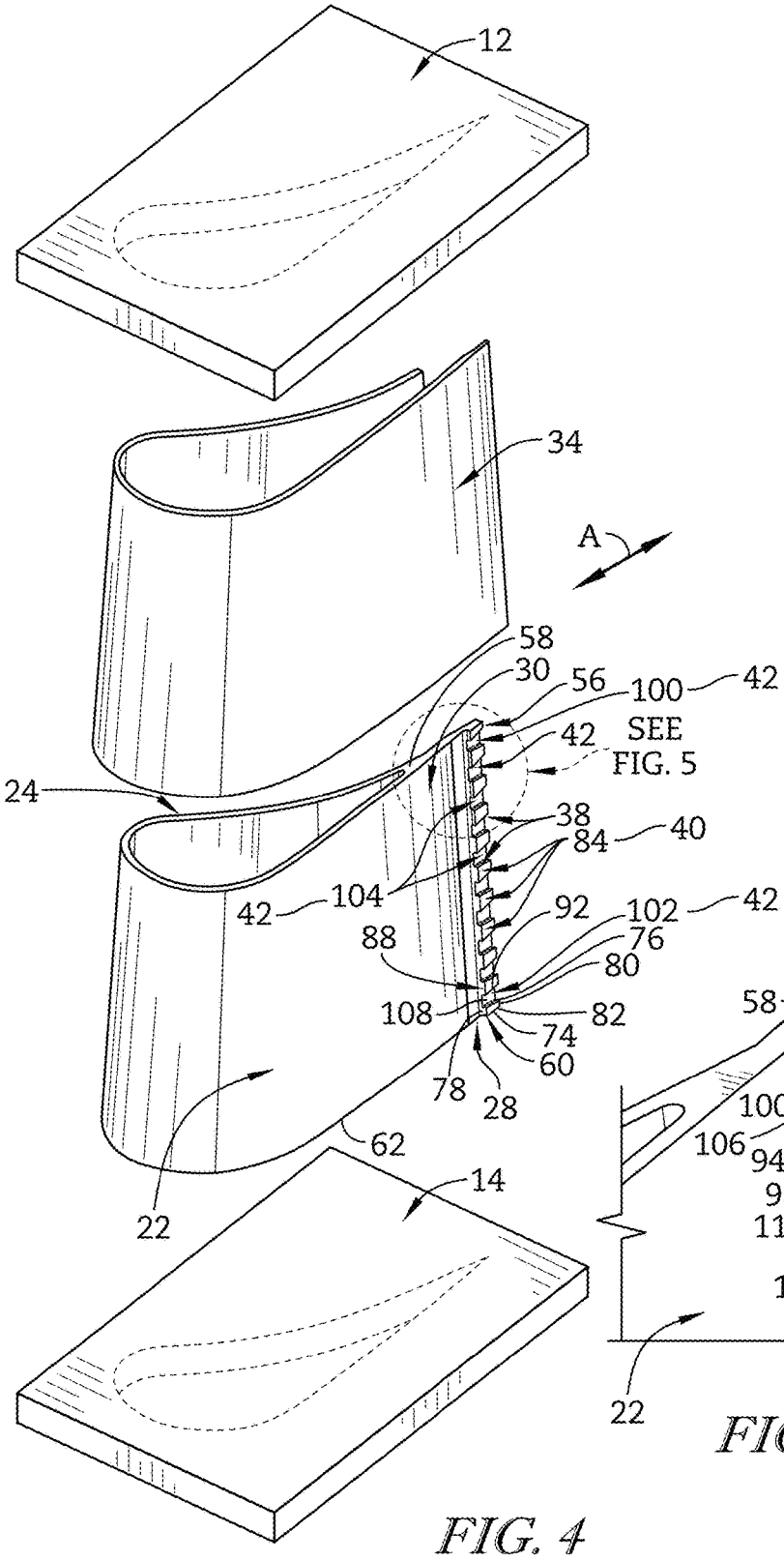
FIG. 4 is an exploded perspective view of the segment of FIG. 1 showing that the tabs of the spar included in the airfoil define outwardly-opening channels at the trailing edge of the airfoil.
Figure 5:
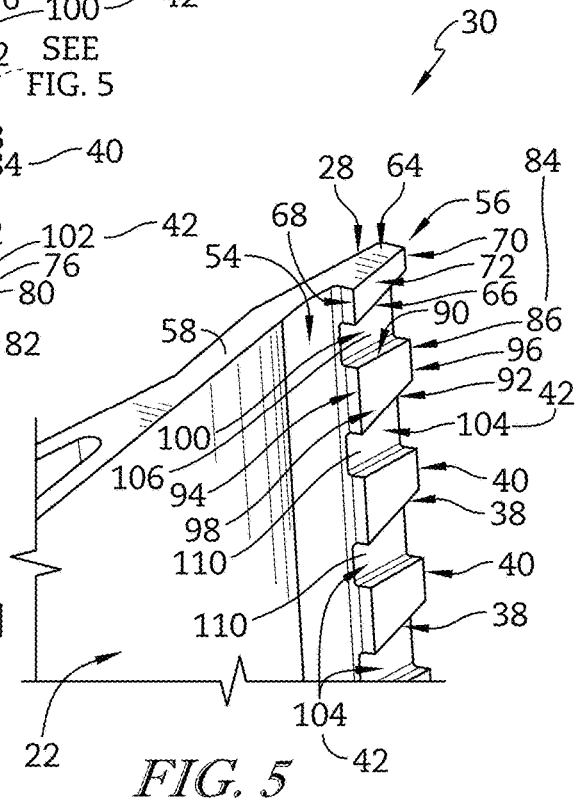
FIG. 5 is a detail view of the outwardly-opening channels of the spar shown in FIG. 4 showing that the outwardly-opening channels diverge as they extend toward the trailing edge of the airfoil.

The spar 30 includes thickened portions 38 that create tabs 40 at the trailing edge 28 of the airfoil 16 along the suction side 22 as best seen in FIGS. 4-5. The tabs 40 define outwardly-opening channels 42 at the trailing edge 28 of the airfoil 16. The cover sheet 34 is bonded to the tabs 40 to create slots 44 at the trailing edge 28 of the airfoil 16.

The illustrative airfoil 16 may provide a number of component features, which are described in greater detail below. The stiffness of the spar 30 included in the airfoil 16 may facilitate bonding with the cover sheet 34 and may control deformation of the airfoil 16 in response to experiencing operational loads. The relatively thin thickness of the trailing edge 28 of the airfoil 16 allowed by the disclosed design may facilitate cooling of the airfoil 16 and allow operating efficiency gains for a gas turbine engine including the airfoil 16.

Figure 3:
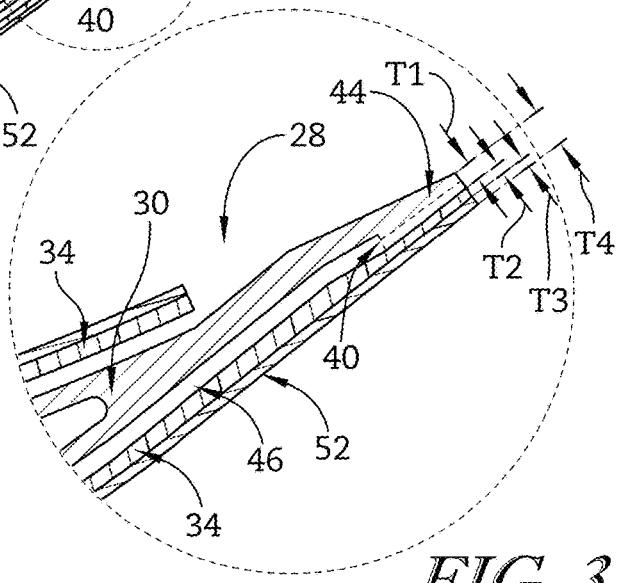
FIG. 3 is a detail view of a trailing edge of the airfoil of FIG. 2 showing that the spar includes thickened portions creating tabs that are bonded to the cover sheet to create slots at the trailing edge of the airfoil that open into the cooling cavity.

In the illustrative embodiment, the outwardly-opening channels 42 of the spar 30 are features provided solely by the spar 30 as shown in FIG. 4. In contrast, the slots 44 are features cooperatively provided by the outwardly-opening channels 42 of the spar 30 and the cover sheet 34. Put another way, when the cover sheet 34 is not bonded to the tabs 40 of the spar 30, the outwardly-opening channels 42 are bounded on three sides and are open along the suction side 22 of the airfoil 16 as shown in FIGS. 4-5. When the cover sheet 34 is bonded to the tabs 40 as shown in FIGS. 2-3, the cover sheet 34 closes off the outwardly-opening channels 42 along the suction side 22 of the airfoil 16 to create the slots 44 bounded on four sides.

Referring back to FIG. 2, the cover sheet 34 and the spar 30 illustratively extend forward of the tabs 40 to the leading edge 26 and therefrom to the point 36 to define a cooling cavity 46 therebetween. The cooling cavity 46 does not extend to the trailing edge 28. Rather, the cooling cavity 46 terminates at the tabs 40 as shown in FIGS. 2-3.

The spar 30 is illustratively formed to include cooling air passages 48 that extend from the interior space 32 to the cooling cavity 46 as shown in FIG. 2. The interior space 32 is embodied as, or otherwise includes, a central cooling air plenum 50 adapted to be pressurized with cooling air. The cooling air passages 48 fluidly couple the plenum 50 to the cooling cavity 46 to conduct cooling air provided to the plenum 50 to the cooling cavity 46 to cool the airfoil 16 during operation of the gas turbine engine.

The cover sheet 34 is illustratively formed to include film cooling holes 35 extending therethrough to fluidly couple the cover sheet 34 to the cooling cavity 46 as shown in FIG. 2. The film cooling holes 35 may be located along the suction and pressure sides 22, 24 between the leading and trailing edges 26, 28 in a number of suitable positions, such as the positions shown in FIG. 2.

The spar 30 and the cover sheet 34 may have a variety of constructions. In the illustrative example, the cover sheet 34 is constructed of ceramic matrix composite materials and the spar 30 is constructed of metallic materials. In another example, the spar 30 and/or the cover sheet 34 may be constructed of ceramic matrix composite materials. In yet another example, the spar 30 and/or the cover sheet 34 may be constructed of metallic materials. In yet another example still, the spar 30 and the cover sheet 34 may have other suitable constructions.

The airfoil 16 further illustratively includes a thermal barrier coating 52 as shown in FIG. 2. The thermal barrier coating 52 is applied to the cover sheet 34 opposite the cooling cavity 46 so that the coating 52 extends from the trailing edge 28 to the leading edge 26 and therefrom to the point 36 shielding the outer surface of the cover sheet 34. The thermal barrier coating 52 is illustratively embodied as an environmental barrier coating adapted to create a temperature barrier to help the airfoil 16 withstand operating temperatures encountered during operation of the gas turbine engine.

Referring now to FIG. 3, the interface between the cooling cavity 46 and the slots 44 at the trailing edge 28 of the airfoil 16 is shown in greater detail. Each of the slots 44 illustratively opens into and is thereby fluidly coupled to the cooling cavity 46. As such, cooling air may be provided to the slots 44 from the cooling cavity 46 and conducted by the slots 44 through the trailing edge 28 of the airfoil 16 during operation of the gas turbine engine.

Referring now to FIGS. 4-5, the tabs 40 of the spar 30 and the outwardly-opening channels 42 defined by the tabs 40 are shown in greater detail. The tabs 40 are illustratively spaced apart from one another in the radial direction indicated by arrow R along the trailing edge 28 of the airfoil 16. The tabs 40 are interconnected with and extend outwardly from an exterior wall 54 of the spar 30 as best seen in FIG.

5. Each of the outwardly-opening channels 42 is arranged between two of the tabs 40 as best seen in FIG. 4.

In the illustrative embodiment, the tabs 40 and the outwardly-opening channels 42 have a generally trapezoidal shape as shown in FIGS. 4-5. In other embodiments, however, the tabs 40 and the outwardly-opening channels 42 may take the shape of other suitable geometric forms.

Referring now to FIG. 4, the tabs 40 illustratively include a radially outward-most tab 56 that extends to an outward-most surface 58 of the spar 30 in the radial direction indicated by arrow R. Additionally, the tabs 40 include a radially inward-most tab 60 that extends to an inward-most surface 62 of the spar 30 in the radial direction indicated by arrow R. The surfaces 58, 62 are arranged opposite one another. Each of the surfaces 58, 62 extends substantially in an axial direction indicated by arrow A that is substantially orthogonal to the radial direction indicated by arrow R.

The radially outward-most tab 56 illustratively includes a planar top wall 64 that is directly interconnected with the radially outward-most surface 58 as best seen in FIG. 5. The top wall 64 extends substantially parallel to the surface 58 in the axial direction indicated by arrow A. The tab 56 further includes a planar bottom wall 66 that is arranged opposite the top wall 64. The top and bottom walls 64, 66 are interconnected by planar side walls 68, 70 that are arranged opposite one another. The top and bottom walls 64, 66 and the side walls 68, 70 are interconnected with a planar front wall 72.

As best seen in FIG. 5, the top and bottom walls 64, 66 of the radially outward-most tab 56 do not extend parallel to one another in the axial direction indicated by arrow A. Rather, unlike the top wall 64, the bottom wall 66 illustratively extends both in the axial direction indicated by arrow A and the radial direction indicated by arrow R from the side wall 68 to the side wall 70. Specifically, the bottom wall 66 extends aftward in the axial direction indicated by arrow A and outward in the radial direction indicated by arrow R from the side wall 68 to the side wall 70.

The radially inward-most tab 60 illustratively includes a planar bottom wall 74 that is directly interconnected with the radially inward-most surface 62 as shown in FIG. 4. The bottom wall 74 extends substantially parallel to the surface 62 in the axial direction indicated by arrow A. The tab 60 further includes a planar top wall 76 that is arranged opposite the bottom wall 74. The bottom and top walls 74, 76 are interconnected by planar side walls 78, 80 that are arranged opposite one another. The bottom and top walls 74, 76 and the side walls 78, 80 are interconnected with a planar front wall 82.

As shown in FIG. 4, the bottom and top walls 74, 76 of the radially inward-most tab 60 do not extend parallel to one another in the axial direction indicated by arrow A. Rather, unlike the bottom wall 74, the top wall 76 illustratively extends both in the axial direction indicated by arrow A and the radial direction indicated by arrow R from the side wall 78 to the side wall 80. Specifically, the top wall 76 extends aftward in the axial direction indicated by arrow A and inward in the radial direction indicated by arrow R from the side wall 78 to the side wall 80.

The tabs 40 further illustratively include central tabs 84 that are spaced from one another in the radial direction indicated by arrow R between the radially outward-most and radially inward-most tabs 56, 60 as shown in FIG. 4. The central tabs 84 are substantially identical to one another. As such, reference numerals used to describe one of the tabs 84 (with the exception of the numerals 86, 88 discussed below) are applicable to each of the tabs 84.

The central tabs 84 illustratively include a tab 86 that is positioned closer to the radially outward-most tab 56 than any of the other tabs 84 as best seen in FIG. 5. Additionally, the central tabs 84 include a tab 88 that is positioned closer to the radially inward-most tab 60 than any of the other tabs 84 as shown in FIG. 4.

The tab 86 of the central tabs 84 illustratively includes a planar top wall 90 and a planar bottom wall 92 that is arranged opposite the top wall 90 as shown in FIG. 5. The top and bottom walls 90, 92 are interconnected by planar side walls 94, 96 that are arranged opposite one another. The top and bottom walls 90, 92 and the side walls 94, 96 are interconnected with a planar front wall 98.

As best seen in FIG. 5, the top and bottom walls 90, 92 of the tab 86 extend toward one another. Specifically, the top wall 90 extends aftward in the axial direction indicated by arrow A and inward in the radial direction indicated by arrow R from the side wall 94 to the side wall 96. The bottom wall 92 extends aftward in the axial direction indicated by arrow A and outward in the radial direction indicated by R from the side wall 94 to the side wall 96.

The outwardly-opening channels 42 illustratively include a radially outward-most channel 100, a radially inward-most channel 102, and central channels 104 as shown in FIG. 4. The radially outward-most channel 100 is positioned closer to the radially outward-most tab 56 than any of the other channels 42. The radially-inward most channel 102 is positioned closer to the radially inward-most tab 60 than any of the other channels 42. The central channels 104 are spaced from one another in the radial direction indicated by arrow R between the radially outward-most and radially inward-most channels 100, 102. The central channels 104 are substantially identical to one another.

The radially outward-most channel 100 is illustratively defined by the radially outward-most tab 56, the tab 86, and a surface 106 that interconnects the tabs 56, 86 as best seen in FIG. 5. Specifically, the channel 100 is defined by the bottom wall 66 of the tab 56, the top wall 90 of the tab 86, and the surface 106 interconnecting the walls 66, 90. The channel 100 extends aftward in the axial direction indicated by arrow A and both inward and outward in the radial direction indicated by arrow R toward the trailing edge 28 of the airfoil 16. As such, the channel 100 may be said to diverge as the channel 100 extends toward the trailing edge 28 of the airfoil 16.

The radially inward-most channel 102 is illustratively defined by the radially inward-most tab 60, the tab 88, and a surface 108 that interconnects the tabs 60, 88 as shown in FIG. 4. Specifically, the channel 102 is defined by the top wall 76 of the tab 60, the bottom wall 92 of the tab 88, and the surface 108 interconnecting the walls 76, 92. The channel 102 extends aftward in the axial direction indicated by arrow A and both inward and outward in the radial direction indicated by arrow R toward the trailing edge 28 of the airfoil 16. As such, the channel 102 may be said to diverge as the channel 102 extends toward the trailing edge 28 of the airfoil 16.

The central channels 104 are illustratively defined by the central tabs 84 and surfaces 110 that interconnect the tabs 84 as shown in FIG. 4. Specifically, the channels 104 are defined by the top walls 90 of the tabs 84, the bottom walls 92 of the tabs 84, and the surfaces 110 interconnecting the walls 90, 92. The channels 104 extend aftward in the axial direction indicated by arrow A and both inward and outward in the radial direction indicated by arrow R toward the trailing edge 28 of the airfoil 16. As such, the channels 104 may be said to diverge as the channels 104 extend toward the trailing edge 28 of the airfoil 16.

Divergence of the channels 100, 102, 104 as they extend toward the trailing edge 28 of the airfoil 16 may impact the amount of heat transferred from the airfoil 16 to the cooling air conducted through the channels 100, 102, 104. As the channels 100, 102, 104 diverge toward the trailing edge 28, the area bounded by the channels 100, 102, 104 increases. The amount of cooling air occupying the area bounded by the channels 100, 102, 104 may therefore increase. Because heat transfer from the airfoil 16 to the cooling air contained in the channels 100, 102, 104 increases as the channels 100, 102, 104 diverge, the divergence of the channels 100, 102, 104 may lead to lower operating temperatures of the airfoil 16.

Referring back to FIG. 3, the spar 30 illustratively has a thickness T1 of about 0.020 inches at the trailing edge 28 of the airfoil 16. The cover sheet 34 illustratively has a thickness T2 of about 0.010 inches at the trailing edge 28 of the airfoil 16. The thermal barrier coating 52 illustratively has a thickness T3 of about 0.006 inches at the trailing edge of the airfoil 16. As a result, the trailing edge 28 of the illustrative airfoil 16 has a thickness T4 of about 0.036 inches. In other embodiments, however, the spar 30, the cover sheet 34, and the thermal barrier coating 52 may have other suitable thicknesses. In those embodiments, the trailing edge 28 of the airfoil 16 may have another suitable thickness.

Referring to FIGS. 1-5, the spar 30 of the illustrative airfoil 16 may have a greater stiffness at the trailing edge 28 than the stiffnesses of components of other airfoils at the trailing edges thereof. The stiffness of the spar 30 at the trailing edge 28 of the airfoil 16 may facilitate bonding of the cover sheet 34 to the tabs 40 of the spar 30. In other airfoils, the stiffnesses of the airfoil components at the trailing edges thereof may not facilitate bonding to the degree that it is facilitated by the stiffness of the spar 30 at the trailing edge 28 of the airfoil 16. Additionally, the stiffness of the spar 30 at the trailing edge 28 of the airfoil 16 may facilitate controlled deformation of the spar 30 in response to experiencing operational loads. In other airfoils, the stiffnesses of the airfoil components at the trailing edges thereof may not facilitate deformation of the components to the degree that it is facilitated by the stiffness of the spar 30 at the trailing edge 28 of the airfoil 16.

Referring again to FIGS. 1-5, the thickness T4 of the trailing edge 28 of the illustrative airfoil 16 may be smaller than the thicknesses of trailing edges of other airfoils. The benefits associated with the thickness T4 of the trailing edge 28 of the airfoil 16 are twofold. First, the smaller thickness T4 of the airfoil 16 may facilitate cooling of the airfoil 16, thereby reducing the operating temperature of the gas turbine engine component including the airfoil 16 compared to other components including different airfoils. Second, because airfoil thickness reductions may result in efficiency improvements for gas turbine engine components including the airfoils, the gas turbine engine component including the airfoil 16 may achieve a greater efficiency than other components including different airfoils. Such efficiency improvements may be particularly achieved by gas turbine engine components receiving air at very high sonic or even supersonic speeds, such as "high work" turbines.

Referring yet again to FIGS. 1-5, the airfoil 16 may be made by forming the tabs 40, and thus the outwardly-opening channels 42 defined by the tabs 40, in the spar 30. The tabs 40 may be machined into the spar 30. In one example, the tabs 40 may be machined into the spar 30 by an electrical discharge machining (EDM) process, such as a plunge-EDM or wire-EDM process. In another example, the tabs 40 may be machined into the spar 30 by another suitable process, such as a laser-machining process.

Referring still to FIGS. 1-5, the airfoil 16 may be made by machining the cover sheet 34. Specifically, the cover sheet 34 may be machined from a thickness of between about 0.015 inches to 0.020 inches to 0.010 inches before being bonded to the tabs 40 of the spar 30. In one example, the cover sheet 34 may be machined by an electrical discharge machining (EDM) process, such as a plunge-EDM or wire-EDM process. In another example, the cover sheet 34 may be machined by another suitable process, such as a laser-machining process.

Referring yet still to FIGS. 1-5, the airfoil 16 may be made by bonding the machined cover sheet 34 to the tabs 40. Specifically, the machined cover sheet 34 may be bonded to the tabs 40 so that the cover sheet 34 closes off the outwardly-opening channels 42 to create the slots 44 and the cooling cavity 46 is defined between the spar 30 and the cover sheet 34. The thermal barrier coating 52 may then be applied to the cover sheet 34.

Figure 6:
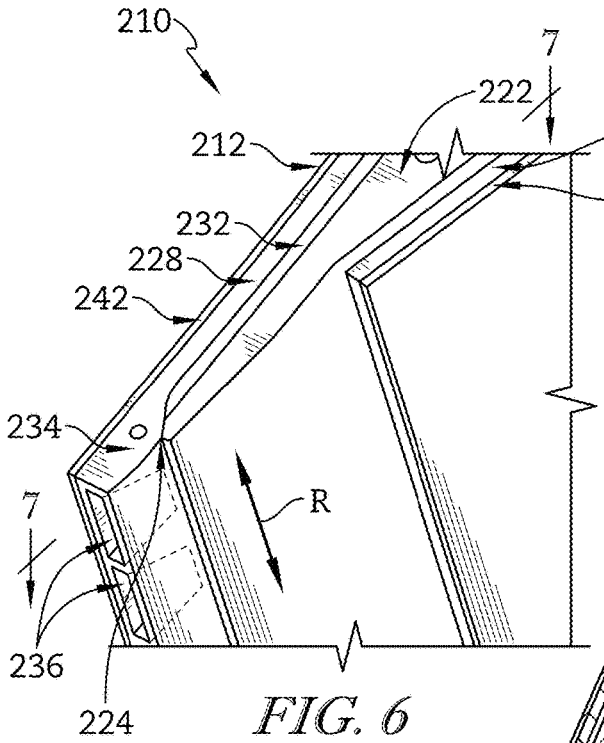
FIG. 6 is a perspective view of a portion of an airfoil of another vane segment adapted for use in a gas turbine engine showing that the airfoil includes a spar and a cover sheet that is formed to include slots extending beyond the spar to a trailing edge of the airfoil.

Referring now to FIG. 6, a vane segment 210 illustratively configured for use in a gas turbine engine is shown. The segment 210 is illustratively embodied as a single vane adapted for use in a turbine or in a compressor. In other embodiments, however, the segment 210 may be embodied as a multi-vane segment adapted for use in a turbine or in a compressor.

Figure 7:
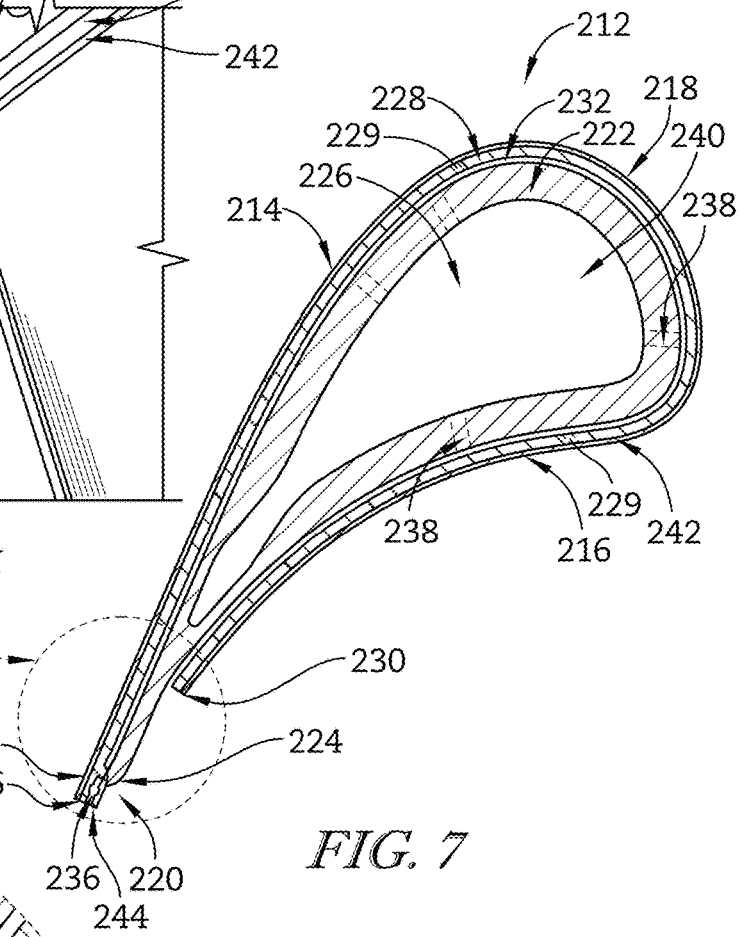
FIG. 7 is a cross-sectional view of the airfoil of FIG. 6 taken along line 7-7 showing that the spar terminates at a point located forward of the trailing edge of the airfoil and that the cover sheet is coupled to the spar to form a cooling cavity between the spar and the cover sheet.

The segment 210 illustratively includes an airfoil 212 as shown in FIGS. 6-7. The airfoil 212 includes a suction side 214 and a pressure side 216 arranged opposite the suction side 214. The suction and pressure sides 214, 216 are interconnected by a leading edge 218 and a trailing edge 220 arranged opposite the leading edge 218.

The airfoil 212 illustratively includes a spar 222 that extends from the leading edge 218 to a point 224 located forward of the trailing edge 220 and defines an interior space 226 as best seen in FIG. 7. The airfoil 212 also includes a cover sheet 228 that extends around the spar 222 at the leading edge 218. Along the pressure side 216 of the airfoil 212, the cover sheet 228 terminates at a point 230 located forward of the trailing edge 220. However, along the suction side 214 of the airfoil 212, the cover sheet 228 extends from the point 224 to the trailing edge 220. Because the illustrative airfoil 212 includes the spar 222 and the cover sheet 228, the airfoil 212 may be referred to as a dual-wall airfoil.

The cover sheet 228 and the spar 222 are illustratively coupled together to form a cooling cavity 232 between the cover sheet 228 and the spar 222 as shown in FIGS. 6-7. The cover sheet 228 includes a thickened portion 234 along the trailing edge 220 that is formed to include slots 236. The slots 236 extend from the trailing edge 220 to the cooling cavity 232 to fluidly couple the cooling cavity 232 to the trailing edge 220.

The slots 236 are illustratively spaced apart from one another in a radial direction indicated by arrow R extending along the trailing edge 220 as shown in FIG. 6. Additionally, as best seen in FIG. 6, the slots 236 diverge as they extend toward the trailing edge 220. In the illustrative embodiment, the slots 236 are generally trapezoidal-shaped. In other embodiments, however, the slots 236 may take the shape of other suitable geometric forms.

Divergence of the slots 236 as they extend toward the trailing edge 220 of the airfoil 212 may impact the amount of heat transferred from the airfoil 212 to the cooling air conducted through the slots 236. As the slots 236 diverge toward the trailing edge 220, the area bounded by the slots 236 increases. The amount of cooling air occupying the area bounded by the slots 236 may therefore increase. Because heat transfer from the airfoil 212 to the cooling air contained in the slots 236 increases as the slots 236 diverge, the divergence of the slots 236 may lead to lower operating temperatures of the airfoil 212.

The illustrative airfoil 212 may provide a number of component features, which are described in greater detail below. The stiffness of the spar 222 included in the airfoil 212 may facilitate bonding with the cover sheet 228 and may control deformation of the airfoil 212 in response to experiencing operational loads. The relatively thin thickness of the trailing edge 220 of the airfoil 212 allowed by the disclosed design may facilitate cooling of the airfoil 212 and allow operating efficiency gains for a gas turbine engine including the airfoil 212.

Figure 8:
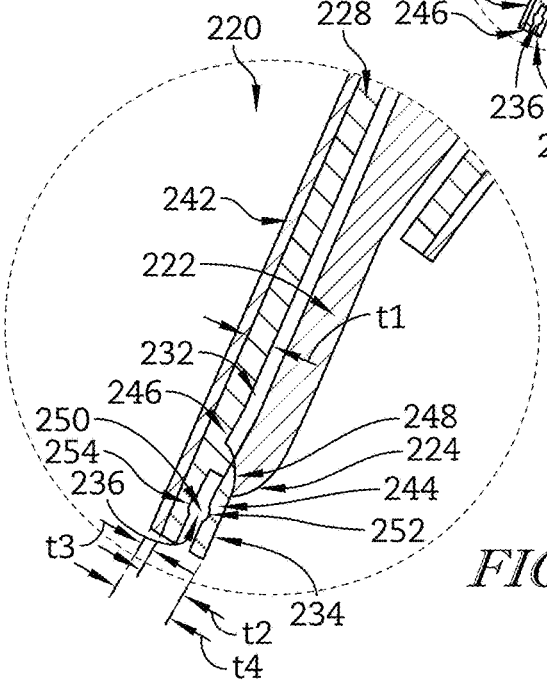
FIG. 8 is a detail view of the trailing edge of the airfoil of FIG. 7 showing that the slots of the cover sheet extend from the trailing edge of the airfoil to the cooling cavity to fluidly couple the cooling cavity to the trailing edge of the airfoil.

The cover sheet 228 and the spar 222 illustratively extend forward of the point 224 to the leading edge 218 and therefrom to the point 230 to define the cooling cavity 232 therebetween as shown in FIGS. 6-7. The cooling cavity 232 does not extend to the trailing edge 220. Rather, the cooling cavity 232 terminates adjacent the point 224 as shown in FIGS. 6-8.

Referring now to FIG. 7, the spar 222 is illustratively formed to include cooling air passages 238 that extend from the interior space 226 to the cooling cavity 232. The interior space 226 is embodied as, or otherwise includes, a central cooling air plenum 240 adapted to be pressurized with cooling air. The cooling air passages 238 fluidly couple the plenum 240 to the cooling cavity 232 to conduct cooling air provided to the plenum 240 to the cooling cavity 232 to cool the airfoil 212 during operation of the gas turbine engine.

The cover sheet 228 is illustratively formed to include film cooling holes 229 extending therethrough to fluidly couple the cover sheet 228 to the cooling cavity 232 as shown in FIG. 7. The film cooling holes 229 may be located along the suction and pressure sides 214, 216 between the leading and trailing edges 218, 220 in a number of suitable positions, such as the positions shown in FIG. 7.

The spar 222 and the cover sheet 228 may have a variety of constructions. In the illustrative example, the cover sheet 228 is constructed of ceramic matrix composite materials and the spar 222 is constructed of metallic materials. In another example, the spar 222 and/or the cover sheet 228 may be constructed of ceramic matrix composite materials. In yet another example, the spar 222 and/or the cover sheet 228 may be constructed of metallic materials. In yet another example still, the spar 222 and the cover sheet 228 may have other suitable constructions.

The airfoil 212 further illustratively includes a thermal barrier coating 242 as shown in FIG. 7. The thermal barrier coating 242 is applied to the cover sheet 228 opposite the cooling cavity 232 so that the coating 242 extends from the trailing edge 220 to the leading edge 218 and therefrom to the point 230 shielding the outer surface of the cover sheet 228. The thermal barrier coating 242 is illustratively embodied as an environmental barrier coating adapted to create a temperature barrier to help the airfoil 212 withstand operating temperatures encountered during operation of the gas turbine engine.

The thickened portion 234 of the cover sheet 228 illustratively includes a segment 244 and a segment 246 interconnected with the segment 244 as shown in FIG. 7. Each of the segments 244, 246 extends to the trailing edge 220 from the point 224. The segments 244, 246 are integral with one another and cooperate to define the slots 236 as best seen in FIG. 8.

Referring now to FIG. 8, the segment 244 is coupled to the spar 222 at the point 224. In the illustrative embodiment, the spar 222 is formed to include a notch 248, and the segment 244 is received by the notch 248 to couple the segment 244 to the spar 222 at the point 224. In other embodiments, however, the segment 244 may be formed to include the notch, and the spar 222 may be received by the notch in the segment 244 to couple the segment 244 to the spar 222 at the point 224. In any case, the segment 244 may be bonded to the spar 222 at the point 224 to couple the cover sheet 228 to the spar 222.

The segments 244 and 246 of the thickened portion 234 illustratively cooperate to partially define a cooling path 250 as shown in FIG. 8. Specifically, a generally semicircular-shaped groove 252 formed in the segment 244 and a generally-shaped semicircular groove 254 formed in the segment 246 cooperate to partially define the cooling path 250. In other embodiments, however, the grooves 252, 254 may take the shape of other suitable geometric forms.

The cooling path 250 extends through the slots 236 in the radial direction indicated by arrow R along the trailing edge 220 of the airfoil 212. Cooling air conducted to the cooling cavity 232 passes through the cooling path 250 as the cooling air is conducted by the slots 236 to the trailing edge 220 during operation of the gas turbine engine.

A thickness t1 of the cover sheet 228 measured forward of the point 224 is illustratively different from a thickness t2 of the cover sheet 228 measured at the trailing edge 220 of the airfoil 212 as shown in FIG. 8. The thickness t1 of the cover sheet 228 is illustratively less than the thickness t2 of the cover sheet 228. The thickness t2 represents the thickness of the thickened portion 234 of the cover sheet 228.

The thickness t2 of the cover sheet 228 at the trailing edge 220 of the airfoil 212 is illustratively about 0.033 inches. The thermal barrier coating 242 illustratively has a thickness t3 of about 0.006 inches at the trailing edge 220. As a result, the trailing edge 220 of the illustrative airfoil 212 has a thickness t4 of about 0.039 inches. In other embodiments, however, the cover sheet 228 and the thermal barrier coating 242 may have other suitable thicknesses. In those embodiments, the trailing edge 220 of the airfoil 212 may have another suitable thickness.

Referring to FIGS. 6-8, the spar 222 of the illustrative airfoil 212 may have a greater stiffness at the trailing edge 220 than the stiffnesses of components of other airfoils at the trailing edges thereof. The stiffness of the spar 222 at the trailing edge 220 of the airfoil 212 may facilitate bonding of the cover sheet 228 to the spar 222. In other airfoils, the stiffnesses of the airfoil components at the trailing edges thereof may not facilitate bonding to the degree that it is facilitated by the stiffness of the spar 222 at the trailing edge 220 of the airfoil 212. Additionally, the stiffness of the spar 222 at the trailing edge 220 of the airfoil 212 may facilitate controlled deformation of the spar 222 in response to experiencing operational loads. In other airfoils, the stiffnesses of the airfoil components at the trailing edges thereof may not facilitate deformation of the components to the degree that it is facilitated by the stiffness of the spar 222 at the trailing edge 220 of the airfoil 212.

Referring again to FIGS. 6-8, the thickness t4 of the trailing edge 220 of the illustrative airfoil 212 may be smaller than the thicknesses of trailing edges of other airfoils. The benefits associated with the thickness t4 of the trailing edge 220 of the airfoil 212 are twofold. First, the smaller thickness t4 of the airfoil 212 may facilitate cooling of the airfoil 212, thereby reducing the operating temperature of the gas turbine engine component including the airfoil 212 compared to other components including different airfoils. Second, because airfoil thickness reductions may result in efficiency improvements for gas turbine engine components including the airfoils, the gas turbine engine component including the airfoil 212 may achieve a greater efficiency than other components including different airfoils. Such efficiency improvements may be particularly achieved by gas turbine engine components receiving air at very high sonic or even supersonic speeds, such as "high work" turbines.

Referring yet again to FIGS. 6-8, the airfoil 212 may be made by forming the slots 236 in the spar 222. The slots 236 may be machined into the spar 222. In one example, the slots 236 may be machined into the spar 222 by an electrical discharge machining (EDM) process, such as a plunge-EDM or wire-EDM process. In another example, the slots 236 may be machined into the spar 222 by another suitable process, such as a laser-machining process.

Referring still to FIGS. 6-8, the airfoil 212 may be made by forming the cooling path 250 in the segments 244, 246 of the thickened portion 234 of the cover sheet 228. The cooling path 250 may be machined into the segments 244, 246. In one example, the cooling path 250 may be machined into the segments 244, 246 by an electrical discharge machining (EDM) process, such as a plunge-EDM or wire-EDM process. In another example, the cooling path 250 may be machined into the spar 222 by another suitable process, such as a laser-machining process Referring yet still to FIGS. 6-8, the airfoil 212 may be made by forming the notch 248 in the spar 222. The notch 248 may be machined into the spar 222. In one example, the notch 248 may be machined into the spar 222 by an electrical discharge machining (EDM) process, such as a plunge-EDM or wire-EDM process. In another example, the notch 248 may be machined into the spar 222 by another suitable process, such as a laser-machining process.

Finally, referring once more to FIGS. 6-8, the airfoil 212 may be made by positioning the segment 244 in the notch 248. Additionally, the airfoil 212 may be made by bonding the segment 244 received in the notch 248 to the spar 222 to couple the cover sheet 228 to the spar 222 and define the cooling cavity 232 between the spar 222 and the cover sheet 228.

Existing dual-wall airfoil fabrication methods may bond together airfoil spars and coversheets that may be thin and flexible at their trailing edges. Such flexibility may lead to unbonding of the airfoil components and undesirable airfoil trailing edge geometry following bonding.

The present disclosure may address the drawbacks associated with these existing methods. In one design contemplated by this disclosure, the spar of the airfoil, such as the spar 30 of the airfoil 16, may be thickened at the trailing edge, such as the trailing edge 28. In this design, the pattern layer, such as the cooling cavity 46, may be prevented from contributing to the thickness of the airfoil at the trailing edge, such as the thickness T4 of the airfoil 16 at the trailing edge 28. In another design contemplated by this disclosure, the cover sheet of the airfoil, such as the cover sheet 228 of the airfoil 212, may be thickened at the trailing edge, such as the trailing edge 220. In this design, the pattern layer, such as the cooling cavity 232, may be prevented from contributing to the thickness of the airfoil at the trailing edge, such as the thickness t4 of the airfoil 212 at the trailing edge 220.

The designs contemplated by this disclosure may provide a number of features. For instance, the designs may allow an airfoil having a stiffer trailing edge to be achieved than the airfoils produced using the existing methods. Additionally, the trailing edges of the airfoils contemplated by this disclosure may be thinner than the trailing edges of the airfoils produced using the existing methods. As a result, the airfoils contemplated by this disclosure may be operated at lower temperatures and may allow greater operating efficiencies to be achieved than the airfoils produced using the existing methods.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. An airfoil comprising an airfoil shaped spar having a suction side wall, a pressure side wall spaced apart from and arranged opposite the suction side wall, a leading edge, and a trailing edge, the pressure side wall extends between and interconnects the leading edge and the trailing edge of the airfoil shaped spar, the suction side wall extends between and interconnects the leading edge and the trailing edge of the airfoil shaped spar, the pressure side wall, the suction side wall, the trailing edge, and the leading edge of the airfoil shaped spar defining an interior space of the spar that provides a central cooling air plenum adapted to be pressurized with cooling air, and the suction side wall of the spar includes thickened portions creating tabs integrally formed with the spar and located at a terminal end of the trailing edge of the spar and extending from the suction side wall of the spar away from the pressure side wall to define a plurality of outwardly-opening channels at a terminal end of a trailing edge of the airfoil and a cover sheet extending around at least a portion of the spar, wherein the cover sheet extends along at least a portion of the pressure side wall, around the leading edge, and along the suction side wall of the spar and bonded to the tabs of the spar to create slots at the terminal end of the trailing edge of the airfoil such that the slots are adapted to open directly to a gas path surrounding the airfoil and such that the tabs form a portion of the terminal end of the trailing edge of the airfoil and are exposed to the gas path, wherein the spar and the cover sheet cooperate to define a cooling cavity that extends continuously between the cover sheet and the pressure side wall, the suction side wall, and the leading edge of the spar, the cooling cavity is fluidly connected directly to each of the slots at the trailing edge of the airfoil, the cooling cavity has a larger radial height than a radial height of each of the slots, and the spar is formed to include cooling air passages that fluidly couple the central cooling air plenum defined by the interior space of the spar to the cooling cavity.

2. The airfoil of claim 1, wherein the tabs are spaced apart from one another in a radial direction extending along the trailing edge of the airfoil.

3. The airfoil of claim 1, wherein the tabs are shaped so that the outwardly-opening channels diverge as they extend toward the trailing edge of the airfoil.

4. The airfoil of claim 1, further comprising a thermal barrier coating applied to at least a portion of the cover sheet facing outwardly away from the cooling cavity.

5. The airfoil of claim 4, wherein the portion of the cover sheet extends to the trailing edge of the airfoil and forward of the tabs.

6. An airfoil comprising an airfoil shaped spar terminating at a point located forward of a terminal end of a trailing edge of the airfoil, the spar having a suction side wall, a pressure side wall spaced from and arranged opposite the suction side wall, a leading edge, and a trailing edge, the pressure side wall extends between and interconnects the leading edge and the trailing edge of the spar, the suction side wall extends between and interconnects the leading edge and the trailing edge of the spar, and the pressure side wall, the suction side wall, the trailing edge, and the leading edge of the spar define an interior space of the spar that provides a central cooling air plenum adapted to be pressurized with cooling air, and a cover sheet extending around at least a portion of the spar and coupled to the spar to form a cooling cavity located between the cover sheet and the pressure side wall, the suction side wall, and the leading edge of the spar and wherein the cover sheet includes a thickened portion that extends beyond the point to the terminal end of the trailing edge of the airfoil, the thickened portion directly contacting the spar, and the thickened portion formed to define entirely therein a plurality of slots that extend from the terminal end of the trailing edge of the airfoil to the cooling cavity to fluidly couple the cooling cavity to each of the plurality of slots at the trailing edge of the airfoil, wherein the spar is formed to include cooling air passages that fluidly couple the central cooling air plenum defined by the interior spar of the spar to the cooling cavity and the cooling cavity has a larger radial height than a radial height of each of the plurality of slots.

7. The airfoil of claim 6, wherein a thickness of the cover sheet measured forward of the point is less than a thickness of the cover sheet measured at the trailing edge of the airfoil.

8. The airfoil of claim 6, wherein the slots are spaced apart from one another in a radial direction extending along the trailing edge of the airfoil.

9. The airfoil of claim 6, wherein a concave notch is formed in the spar the thickened portion has a convex surface that is received by the notch to couple the thickened portion to the spar at the point.

10. The airfoil of claim 9, further comprising a thermal barrier coating applied to the cover sheet opposite the cooling cavity.

11. The airfoil of claim 9, wherein a cooling path extending through the plurality of slots in a radial direction along the trailing edge of the airfoil is defined by the thickened portion.

12. The airfoil of claim 6, wherein the slots diverge as they extend toward the trailing edge of the airfoil.

13. The airfoil of claim 1, wherein the trailing edge of the spar has a first thickness in a first direction, the cover sheet has a second thickness in the first direction where the cover sheet is bonded to the trailing edge of the spar, and the second thickness is less than the first thickness.

14. The airfoil of claim 1, wherein the cover sheet extends only partway along the pressure side wall of the spar so that a portion of the pressure side wall of the spar adjacent the trailing edge of the spar forms an outermost surface of the airfoil.

15. An airfoil comprising an airfoil shaped spar having a suction side wall, a pressure side wall spaced apart from and arranged opposite the suction side wall, a leading edge, and a trailing edge, the pressure side wall extends between and interconnects the leading edge and the trailing edge of the airfoil shaped spar, the suction side wall extends between and interconnects the leading edge and the trailing edge of the airfoil shaped spar, the pressure side wall, the suction side wall, the trailing edge, and the leading edge of the airfoil shaped spar defining an interior space of the spar that provides a central cooling air plenum adapted to be pressurized with cooling air, and the suction side wall of the spar includes thickened portions creating tabs integrally formed with the spar and located at a terminal end of the trailing edge of the spar and extending from the suction side wall of the spar away from the pressure side wall to define a plurality of outwardly-opening channels at a terminal end of a trailing edge of the airfoil and a cover sheet extending around at least a portion of the spar, wherein the cover sheet extends along at least a portion of the pressure side wall, around the leading edge, and along the suction side wall of the spar and bonded to the tabs of the spar to create slots at the terminal end of the trailing edge of the airfoil such that the slots are adapted to open directly to a gas path surrounding the airfoil and such that the tabs form a portion of the terminal end of the trialing edge of the airfoil and are exposed to the gas path, wherein the spar and the cover sheet cooperate to define a cooling cavity that extends continuously between the cover sheet and the pressure side wall, the suction side wall, and the leading edge of the spar, the cooling cavity is fluidly connected directly to each of the slots at the trailing edge of the airfoil, the cooling cavity has a larger radial height than a radial height of each of the slots, and the spar is formed to include cooling air passages that fluidly couple the central cooling air plenum defined by the interior space of the spar to the cooling cavity, and wherein the cover sheet has a first trailing edge along a pressure side of the cover sheet with a first thickness and a second trailing edge arranged along the suction side of the cover sheet and aligned with the trailing edge of the airfoil shaped spar, the second trailing edge having a second thickness that is less than the first thickness across the entire radial height of the cooling cavity.

16. The airfoil of claim 6, wherein the cover sheet has a first trailing edge along a pressure side of the cover sheet with a first thickness and a second trailing edge offset aft from the first trailing edge and arranged along the suction side of the cover sheet with a second thickness, and the first thickness is less than the second thickness.

17. The airfoil of claim 16, wherein the first thickness and the second thickness are constant across the radial height of the cooling cavity.

18. The airfoil of claim 16, wherein the plurality of slots are formed entirely within the second trailing edge and the first thickness of the first trailing edge is constant across the radial height of the cooling cavity.

19. The airfoil of claim 6, wherein the thickened portion is formed to include a first semicircular groove and a second semicircular groove spaced apart from the first semicircular groove.

20. The airfoil of claim 19, wherein the first semicircular groove and the second semicircular groove extend through the plurality of slots in a radial direction along the trailing edge of the airfoil to provide a cooling path through the thickened portion.

* * * * *